US010766737B2

(12) United States Patent
Salmikuukka

(10) Patent No.: US 10,766,737 B2
(45) Date of Patent: Sep. 8, 2020

(54) DESTINATION CONTROL SYSTEM

(71) Applicant: KONE CORPORATION, Helsinki (FI)

(72) Inventor: Jukka Salmikuukka, Espoo (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/143,779

(22) Filed: May 2, 2016

(65) Prior Publication Data

US 2016/0244295 A1 Aug. 25, 2016

Related U.S. Application Data

(63) Continuation of application No. PCT/EP2013/074032, filed on Nov. 18, 2013.

(51) Int. Cl.

| | |
|---|---|
| ***B66B 1/22*** | (2006.01) |
| ***B66B 1/46*** | (2006.01) |
| ***B66B 1/24*** | (2006.01) |

(52) U.S. Cl.

CPC ..... *B66B 1/2458* (2013.01); *B66B 1/468* (2013.01); *B66B 2201/103* (2013.01); (Continued)

(58) Field of Classification Search

USPC ..... 187/382

See application file for complete search history.

(56) References Cited

U.S. PATENT DOCUMENTS 5,831,226 A * 11/1998 Hattori ..... B66B 1/2458 187/382

5,892,190 A * 4/1999 Morita ..... B66B 1/18 187/382

(Continued)

FOREIGN PATENT DOCUMENTS

WO WO 2006/070051 A2 7/2006

*Primary Examiner* — Christopher Uhlir

(74) *Attorney, Agent, or Firm* — Birch, Stewart, Kolasch & Birch, LLP

(57) ABSTRACT

The invention relates to a destination control system of an elevator system having at least one elevator group, wherein a destination call is input via at least one destination call input device to the destination control system to be allocated to at least one of the elevators of the elevator group to service the destination call. The destination call input device further includes an optional input for a desired operating time of a so called "pre-booked" destination call and the destination control system comprises a memory for pre-booked destination call data comprising the departure floor, the destination floor, a correlated operating time for the pre-booked destination call as well as a correlated identifier of the user having issued the pre-booked destination call, in which destination control system the pre-booked destination calls are allocated to the elevators of the elevator group with a higher priority than not pre-booked destination calls. Further, the destination control system has at least one identification reader arranged at least in the vicinity of the elevators to obtain an identifier input by the elevator user, and a pre-booked destination call is confirmed by the destination control system only after it has been checked that the identifier obtained by the identification reader corresponds to the identifier correlated to the pre-booked destination call. The invention rewards pre-booking of destination calls and leads thus to a better efficiency of the elevator system.

19 Claims, 2 Drawing Sheets

Figure 1:
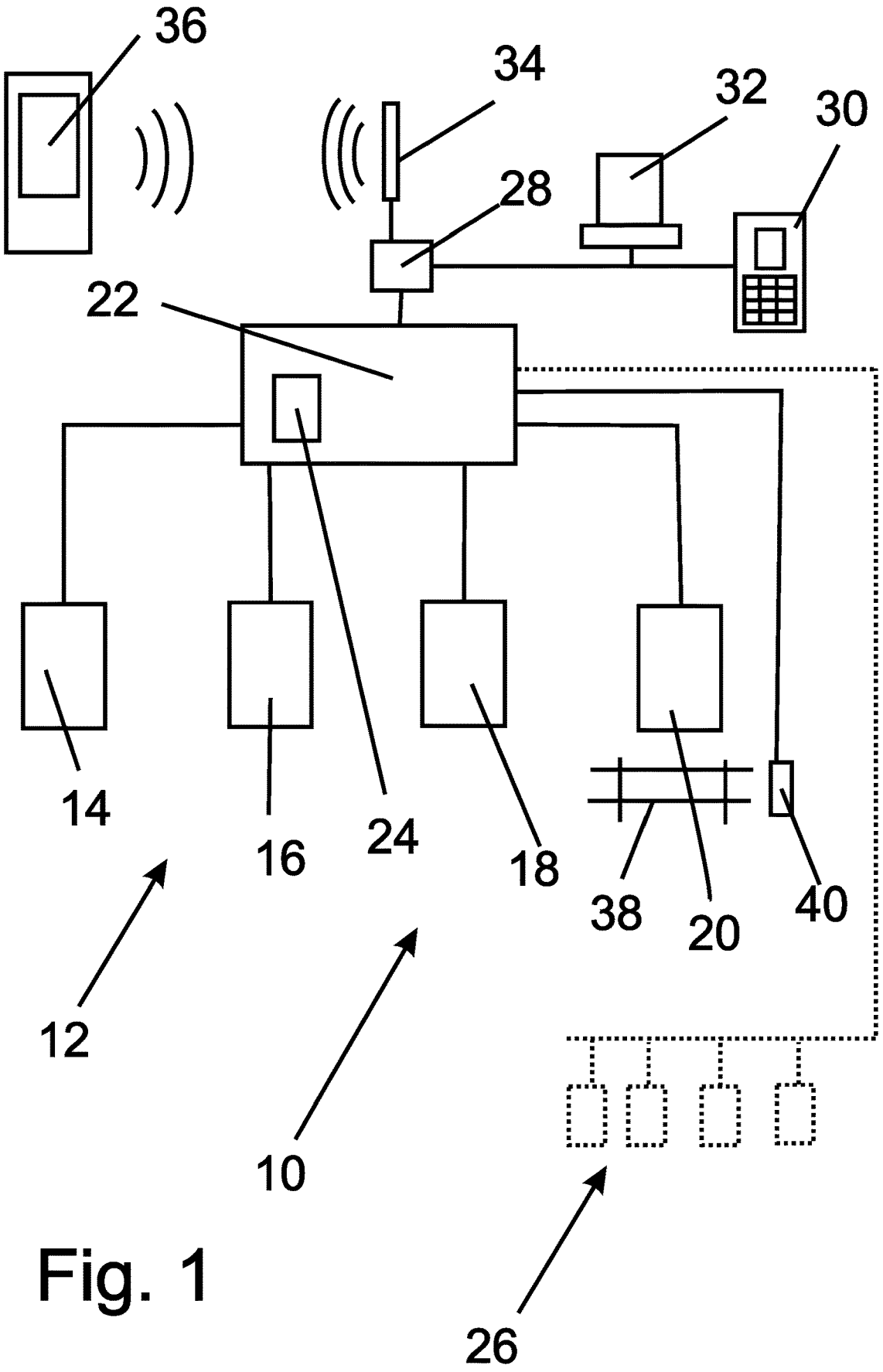

(52) U.S. Cl.
CPC ... *B66B 2201/404* (2013.01); *B66B 2201/405* (2013.01); *B66B 2201/463* (2013.01); *B66B 2201/4653* (2013.01); *B66B 2201/4676* (2013.01)

(56) References Cited

U.S. PATENT DOCUMENTS

| | | | | |
|---|---|---|---|---|
| 6,425,460 | B2 * | 7/2002 | Schuster | B66B 1/34 187/247 |
| 7,377,364 | B2 * | 5/2008 | Tyni | B66B 1/468 187/380 |
| 7,500,544 | B2 * | 3/2009 | Hakala | B66B 1/463 187/382 |
| 2006/0065490 | A1 * | 3/2006 | Zaharia | B66B 1/468 187/384 |
| 2010/0078266 | A1 * | 4/2010 | Choi | B66B 1/2433 187/247 |
| 2011/0132699 | A1 * | 6/2011 | Tokura | B66B 3/00 187/382 |
| 2012/0018257 | A1 * | 1/2012 | Tokura | B66B 1/2458 187/387 |
| 2012/0138389 | A1 * | 6/2012 | Furutani | B66B 1/468 187/247 |
| 2012/0160612 | A1 * | 6/2012 | de Groot | B66B 1/2458 187/247 |
| 2014/0284145 | A1 * | 9/2014 | Finschi | B66B 1/2458 187/382 |
| 2014/0339023 | A1 * | 11/2014 | Friedli | B66B 1/2408 187/247 |

* cited by examiner

DESTINATION CONTROL SYSTEM

CROSS REFERENCE TO RELATED APPLICATIONS

This application is a Continuation of PCT International Application No. PCT/EP2013/074032, filed on Nov. 18, 2013, which is hereby expressly incorporated by reference into the present application.

The present invention relates to a destination control system of an elevator group wherein a destination call is input via at least one destination call input device to the destination control system to be allocated to at least one of the elevators of at least one elevator group of an elevator system to service the destination call. The advantage of destination control systems in the allocation of landing calls to the elevators of an elevator group is that the elevator control knows the departure floor as well as the destination floor and is accordingly aware of the complete traffic routes in the elevator system which facilitates the allocation of elevators to landing calls. Recently, destination control systems also offer the option of pre-booked destination calls which do not only include the departure floor and the destination floor but also a correlated operation time for the destination call. Via this means, the destination control system knows already at a very early stage about the presence of landing calls and is accordingly able to coordinate the traffic in an elevator system as to better meet the criteria of a cost function which is generally used in for an optimal allocation of landing calls to the elevators. This cost function usually comprises parameters as passenger waiting time, passenger ride time, total journey time, energy consumption, etc. The allocation of landing calls with an allocation algorithm using cost functions is per se known and shall not be explained in greater detail. The cost function ensures a call allocation which selects the elevator which is best adapted to serve a call under the considerations of the optimization criteria of the cost function.

A problem with destination control systems comprising pre-booking function arise in that on one hand a pre-booking function is only adopted by few users and on the other hand the pre-booked calls are sometimes by used by persons which have not booked the call and are thus not entitled to use the pre-booked ride in the elevator car.

The US 2006/065490, the WO 2006/070051 as well as the US 2012/0018257 disclose a destination control system according to the preamble of claim 1.

It is therefore object of the present invention to provide an improved destination control system which leads to a better acceptance of the use of a pre-booking function than in currently known destination control systems.

This object is solved with a destination control system according to claim 1 as well as with elevator group control according to claim 14, an elevator system according to claim 15 as well as a method according to claim 17. Preferred embodiments of the invention are subject-matter of the corresponding dependent claims.

Some inventive embodiments are also discussed in the descriptive section of the present application. The inventive content may also consist of separate inventions, especially if the invention is considered in the light of expressions or implicit subtasks or from the point of view of advantages or categories of advantages achieved. In this case, some of the attributes contained in the claims below may be superfluous from the point of view of separate inventive concepts.

According to the invention, each pre-booked destination call does not only comprise the departure floor and the destination floor as well as a correlated time for the pre-booked destination call but also a correlated identifier of the user which has booked the pre-booked destination call. This identifier is input by the user e.g. manually via the keyboard of a destination input panel. The identifier may further be input by using an identifier card or identifier tag or by using individual destination call input devices as e.g. mobile devices, e.g. mobile phones, in which case the identification of the mobile device allows the transmission or detection of the identifier of the user via the identity of the individual destination call input device. According to the invention, a pre-booked call is always linked to an individual person.

Because by linking the pre-booked call to a defined identifier it can be checked later on whether the pre-booked call is indeed used by the person who has issued the pre-booked call.

The priority handling can in the simplest embodiment only differentiate between pre-booked calls and non pre-booked (instantaneous) calls. A higher priority in call allocation of a pre-booked call can be obtained by different measures. On one hand the priority of a pre-booked call may be increased by reserving at least one particular elevator in the elevator system or a certain space in a least one elevator of the elevator system exclusively to pre-booked calls. On the other hand, i.e. additionally or alternatively to this measure the destination control system can adjust the weighting coefficients of the parameters of a cost function used in the call allocation for a pre-booked call differently than for an instantaneous call, which leads to the change of parameters as passenger waiting time, riding time etc. In this case the passenger waiting time or riding time or total journey time of a pre-booked call can be reduced. This correlates to a kind of VIP-status for pre-booked calls.

To enable the destination control system to verify the use of a pre-booked call by the correct user, at least one identification reader is provided at least in the vicinity of the elevators of the at least one elevator group of the elevator system. The identification reader can for example be located in the elevator lobby or in front of the single elevators or inside the elevators. Preferably, if particular elevators are used for pre-booked calls, the identification reader can be provided in connection with an access gate (e.g. rotating access hub) to the reserved elevator so that only persons having issued a pre-booked call within a certain period, e.g. within the next 5 minutes, are admitted to the reserved particular elevator or to a certain reserved space in an elevator.

The provision of the identification reader also has the advantage that pre-booked calls can be confirmed when being used by the correct user, i.e. the user who has issued the call. This can be important in connection with a reward system of the inventive destination call control system, particularly if the reward system is made user-individual, which is explained hereinafter.

A further optional differentiation of the priority is possible if the priority is user-individually: In this case it can be differentiated between users with non pre-booked calls, unreliable users (=users which sometimes do not use their pre-booked call) and users using reliably pre-booked calls. The borders between these groups may be fluent. Thus the priority can be made dependent on the number of confirmed pre-booked call in the past and or on the number of the unused pre-booked call in the past. The priority of each user can be adjusted individually to the above mentioned call history of a user.

In this case the destination control system comprises a memory for the travel/call history of individual users to allow an evaluation of the behaviour of the user in connection with the elevator system. This allows a correlated grouping of the user into priority categories of the destination call control or even the assigning of an individual priority to each user. The travel history may comprise in a simple embodiment only the number of rides in the elevator system based on pre-booked calls. But the travel history can also comprise additional data, e.g. the total number of rides in the elevator system, the relation of pre-booked calls to non pre-booked calls in the number of rides, the number or portion of confirmed and unused pre-booked calls, the riding time of the pre-booked calls etc. In this case, the priority of the allocation of a pre-booked destination call can be made dependent on the number of confirmed and/or unused pre-booked calls issued by the individual users. The individual priority may for example be the admittance to particular reserved elevators (also here several reserved elevators for different priorities can be provided) or the allocation of individual weighting coefficients for the parameters of a cost function which is used in the call allocation algorithm. With the individual weighting coefficients the individual users can be assigned a shorter waiting time, riding time and/or total journey time. Each confirmation of a pre-booked destination call by the user may lead to the increase of his priority of whereas each non-use of a pre-booked call may lead to a decrease of his priority. Thus, the allocation handling of the individual persons using the elevator group can be monitored so that repeated booking of pre-booked destination calls can be rewarded with a higher priority in the call allocation.

By the above measures the user of an elevator system gets an immediate response of the elevator system in service quality to his pre-booking behaviour. This is important particularly in high-rise elevators having a lot of landing floors, e.g. more than 50, and may be different zones to obtain their destination. The elevator systems of such buildings usually have several elevator groups which serve different zones in the building. Of course, when for a travel in the elevator system a change of the elevator group is necessary for a pre-booked call, elevators in the other elevator groups are also reserved for the pre-booked call, whereby the allocation time considers the travel of the previous elevator to a transfer floor of the elevator system, which is served by two adjacent elevator groups. Accordingly, the elevator group control may comprise a multi-group control which coordinates the travel via several elevator groups. The arrangement of a control for the elevator system, e.g. the separation of an elevator group control in a coordinating multi-group control and/or several combined or separated elevator group controls is performed by the skilled person in course of his routine skills.

Preferably, each user of the elevator system may be allocated an individual priority and the destination call input device may include a display for indicating an allocated elevator as well as for indicating the allocated priority to the user in which case he gets immediate information about his priority status in the elevator system.

The assigning of a certain priority to a user may not only have an effect on the individual weighting coefficients for the parameters of the cost function or the reservation of complete elevators but also to the reservation of certain elevator space in at least one of the elevators of the elevator system so that always sufficient place in the elevators is reserved for pre-booking users.

The invention is preferably advantageous in nowadays elevators wherein the size of the building and the number of landings increases as well as the number of pre-booked calls. As also the time frame of the pre-bookings gets longer, it becomes increasingly important and useful to use the advanced allocation system of the invention.

Pre-booked calls can be grouped and scheduled also according to several other factors for example for security or energy-saving purposes: The inventive pre-booking system is able to handle access rights of the persons in a desired way so that for example pre-booked calls made by persons whose access rights are in conflict with each other are not scheduled and allocated to the same elevator.

The invention also allows a high consideration of energy optimization in the pre-ordered or pre-booked calls which are allocated in such a manner that the overall energy consumption of the elevator system is minimized.

The priority may also be handled by first allocating the pre-booked calls because of their known time frame in the most energy-efficient way and afterwards the in-coming instantaneous calls (=not pre-booked calls) are allocated separately to the most optimal available gaps left over from the pre-bookings. Further the priority can be handled by first allocating the places in the elevators to the users of pre-booked calls and only the remaining space is allocated to the remaining instantaneous calls. This ensures the serving of pre-booked calls with a higher priority than non pre-booked calls.

Preferably, the allocation of destination calls is carried out under use of a cost function wherein different allocation parameters are provided with different weighting coefficients which are to be considered in the allocation decision, whereby the weighting coefficient of the passenger waiting time and/or riding time of a pre-booked call is increased with respect to the corresponding weight coefficient of a non pre-booked destination call. Via this measure it is obtained that the general allocation efficiency for pre-booked calls is with respect to passenger waiting and/or riding better than for non-pre-booked destination calls. This is a clear reward system for users which are reliably using the pre-booking function of the elevator system.

As it has been mentioned above, preferably at least one particular elevator of the elevator group is reserved for pre-booked calls and preferably also a part of the capacity of the elevators in the elevator group(s) of the elevator system is reserved for pre-booked calls. In this case preferably the number of reserved elevators can be set dynamically in accordance with the dynamics of the portion of pre-booked calls to non-pre-booked calls.

Preferably, the at least one particular reserved elevator is located in an access-controlled area where only users get access having an identifier related to a pre-booked destination call in the near future. Via this means, the un-allowed use of pre-booked calls by not authorized users can be efficiently prevented which improves the advantage of pre-booked calls with respect to instantaneous calls. The identification reader is in this case preferably located in connection with an access control, i.e. in connection with a fence or hub of the access controlled area.

The destination call input devices may comprise mobile devices as for example smartphones, terminals or computers which are individually used by the users of the elevator system or by destination input panels located in connection with the elevator group. As far as the destination call input devices are individual, they may be adapted to automatically issue the identifier in connection with a pre-booked call to the destination control system. As far as the destination call input device is publically available as e.g. destination input panels, an identifier has to be input with the issue of a pre-booked call. In any way, the destination control system includes a wired or wireless input node for the different destination call input devices. This arrangement ensures a reliable and safe input of pre-booked calls as well as of non-pre-booked calls into the destination control system.

The destination control system is usually implemented as an algorithm on a microprocessor system.

The destination control system is usually part of an elevator group control or multi-group control for controlling at least one elevator group or an elevator system comprising several elevator groups, e.g. in high-rise buildings having different elevator groups in different zones of the building.

Preferably, the destination control system comprises a cancellation option of a pre-booked call up to a preset time period before the operating time of the pre-booked call. Via this measure, it is possible for the elevator user to cancel a pre-booked call without deteriorating his priority in the pre-booking call system. With the cancellation, the pre-booked call is eliminated from the call allocation system before the call is operated in the allocation system. Thus, the preset time period before the operating time of the pre-booked call is at least the waiting time for the pre-booked call or a time window of the allocation algorithm within which pre-booked calls are entered into the allocation system before the indicated operation time of the allocation (desired allocation time).

The invention further relates to a method for allocating elevator calls to elevators in an elevator system having at least one elevator group with several elevators, wherein a destination call is input via at least one destination call input device into a destination control system to be allocated to at least one of the elevators of the elevator group to service the destination call. In the inventive method, a desired operating time of a so-called pre-booked destination call can be issued so that destination call data comprises the departure floor, the destination floor, a correlated operating time for the pre-booked destination call as well as a correlated identifier of the user issuing the pre-booked destination call. According to the invention, the pre-booked destination calls are allocated with a higher priority to the elevators of the elevator group than the non-pre-booked destination calls, and with the serving of a pre-booked destination call, the identifier of the elevator user having issued the pre-booked destination call is prompted to confirm the correct use of the pre-booked destination call.

The method provides the same advantages as already mentioned with the inventive destination control system, i.e. to ensure the serving of pre-booked destination calls with a high priority compared to destination calls which are not pre-booked (instantaneous destination calls). In the inventive method, the use of the pre-booked call is confirmed by reading an identifier of the elevator user. Via this measure, it can be ensured that the pre-booked call is indeed used by the correct person and it can be ensured that the use of pre-booked calls leads to a better service in the elevator system than instantaneous destination calls.

Particularly, in connection with particular elevators reserved for pre-booked calls or certain areas in at least one particular elevator reserved for pre-booked calls, an access control can be carried out which allows only the users of active pre-booked calls to enter the reserved elevator or area. Via this method, the misuse of pre-booked calls by unauthorized persons can be efficiently eliminated.

Preferably, each user is assigned an individual priority which in the use of the elevator system whereby the priority is dependent on the number of confirmed pre-booked calls stored in a memory of the user's service history of the elevator system. With this system, an efficient use of the pre-booking function is awarded with a higher efficiency of the elevator system for the individual person. For example, the individual priority may directly affect individual weighting coefficients of the parameters of a cost function of an allocation algorithm as e.g. passenger waiting time and/or passenger riding time so that for users with a high priority, the allocation function leads to a better result with respect to these parameters.

According to a preferred embodiment of the invention the destination control system issues upon the registration of a pre-booked call given by an individual destination call input device a confirmation message to said individual destination call input device, which allows the user to get a confirmation of his call mad by an individual destination call input device, e.g. a mobile device, mobile phone, tablet or a computer. This enhances the user comfort of the system for the users of individual destination call input devices.

Furthermore, according to a further preferred embodiment of the invention the destination control system issues—after having made the allocation for the pre-booked call—a message to said individual destination call input device comprising the allocated elevator. Also this measure enhances the service quality of the elevator system for passengers using individual destination call input devices. Of course, this message may advantageously be issued close to the pre-booked service time.

The invention is hereinafter described via an example in connection with the accompanied drawings. In these drawings FIG. 1 shows a schematic diagram of an elevator system having an elevator group with one elevator being reserved for pre-booked calls, FIG. 2 a flow diagram for the allocation of pre-booked and non-pre-booked destination calls.

FIG. 1 shows an elevator system 10 having a first elevator group 12 consisting of four elevators 14, 16, 18, 20 which are connected to an elevator group control 22 comprising a destination control system 24. A further elevator group 26 may be connected to the elevator group control 22 which other elevator group 26 may be arranged in a different zone of the building. The connection of a further elevator group 26 to the elevator group control 22 is optional. The elevator group control 22 comprises an input node 28 to which destination input panels 30 in the different elevator lobbies and several individual computers or terminals 32 are connected via bus/LAN. Furthermore, a wireless access point 34 is connected to the input node 28 which wireless access point 34 is able to communicate via individual mobile devices 36, e.g. smartphones.

The fourth elevator 20 of the first elevator group 12 is a particular elevator reserved for pre-booked calls. This particular reserved elevator 20 is located in an access controlled area which is separated via a fence structure 38 whereby an access hub of said fence structure is provided in the vicinity of an identification reader 40 to allow access to the particular reserved elevator 20 only for the users of active pre-booked calls. Active pre-booked calls are pre-booked calls which are to be served within a certain time frame of e.g. 5 minutes.

The elevator system of FIG. 1 works as follows:

Via the destination call input devices, i.e. the terminal or computer 32, the destination input panel 30 or the mobile device 36, a destination call is input to the destination control system 24 of the elevator group control 22. In case of the computers or terminals 32 and the mobile devices 36, an identifier of the user of the elevator system may automatically be issued with the issuing of the destination call. The computer or terminal 32 and the mobile device 36 also enables the user to input a desired time for the destination call which is the time when the destination call is really operated in the allocation system. On this behalf, a user of the elevator system may issue at twelve o'clock a pre-booked call from the 85th floor to the ground floor at 16:30. This is a pre-booked call which comprises the departure floor, the destination floor as well as the time when the allocation has to be operated. In case of the terminals 32 or mobile devices 36, the identifier can be given automatically. In case of a common destination input panel 30 comprising a display and a decade keyboard, the identifier has to be input manually. In this case, the destination control system 24 in the elevator group control 22 reserves a ride in the particular reserved elevator 20 from the departure floor to the destination floor of the pre-booked call at 16:30. The user is able to gain access into the fenced access area of the particular elevator 20 via a rotation hub which is released after presenting his identifier tag to an identification reader 40 provided in the vicinity of the rotation hub. The access into the access area is possible only within a certain time frame before the operating time of the pre-booked call, i.e. at 16:20 or 16:25 at the earliest. As the destination control system 24 knows the departure floor and destination floor of the pre-booked call long before, it can arrange an energy-saving allocation of the particular elevator 20 to serve the pre-booked call in time in a most economical manner.

Figure 2:
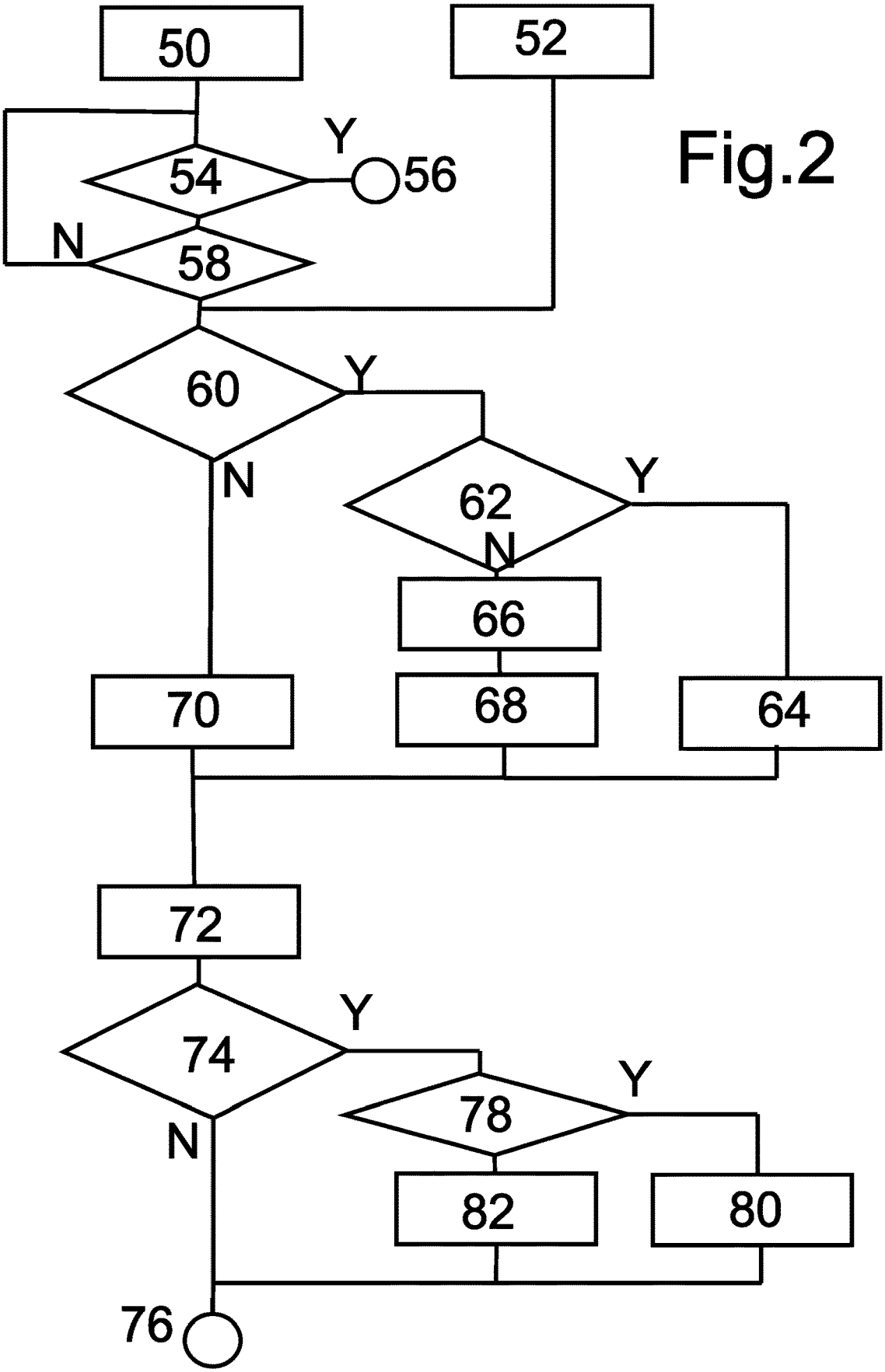

FIG. 2 shows an optional flow diagram for pre-booked calls and non-pre-booked calls. Box 50 is the start box for a pre-booked call wherein the elevator system, i.e. the elevator group control 22 of the elevator system, obtains the departure floor, the destination floor, the operating time of the call allocation as well as an identifier of the user having issued the pre-booked call. Box 52 is the start box for a non-pre-booked call, i.e. an instantaneous destination call which only comprises the departure floor, the destination floor and optionally identification data of the user. In decision field 54, it is prompted whether the pre-booked destination call has meanwhile been cancelled. If yes, the procedure stops at end marker 56. If the pre-booked call is not cancelled, the flow diagram proceeds to decision field 58 wherein the operating time of the pre-booked call is compared with the actual time and it is decided whether the pre-booked call is to be allocated. If no, the process goes back to field 54. If yes, the flow diagram proceeds to decision field 60. Non-pre-booked calls process directly from Box 52 to decision field 60. In decision field 60, it is prompted whether the active call is a pre-booked call. If yes, the flow diagram proceeds to decision field 62 wherein it is checked whether a particular reserved elevator 20 comprises enough space to serve the call. If yes, an allocation procedure for this particular reserved elevator 20 is performed in field 64. If no room in the particular elevator 20 is available, the flow diagram proceeds from decision field 62 to operation field 66 where the identifier of the elevator user is retrieved and the corresponding user-individual priority is obtained to retrieve the priority of the destination call. The individual priority assigned to the destination call in operation field 66 leads in operation field 68 to a call allocation of all other elevators except the particular elevator 20 with a set of individual weighting coefficients leading to a better performance of the call allocation for this pre-booked destination call of the individual user.

Coming back to the third decision field 60 where it is prompted, if the present destination call is a pre-booked call, a negative result leads to the operation field 70 in which a normal call allocation within all elevators of the elevator system except the particular elevator 20 is performed with normal weighting coefficients of the parameters of the cost function corresponding to a low priority of the instantaneous destination call.

The operation fields 70 and 68 connect ahead of operation field 72 in which the allocated elevator is indicated in a display of the destination input panel 30 or in a display of a mobile device 36. In decision field 74, it is again prompted, if the pending destination call is a pre-booked call. If not, the allocation ends at end field 76. yes, the allocation process advances to decision field 78 in which it is prompted if the pre-booked call has been confirmed. If yes, the priority of the individual user is increased in operation field 80. If not, the priority of the individual user is decreased in operation field 82. Afterwards, the allocation procedure ends in the end field 76.

With the above-mentioned allocation method, it is on one hand ensured that the pre-booking user gets a place in the particular reserved elevator 20, if available. However, if no room is available, the allocation procedure still leads to an individual allocation with better weighting coefficients for the passenger sensitive parameters of the cost function of the allocation algorithm as passenger waiting time and passenger riding time which will lead to a better service than any instantaneous destination call.

If no particular elevator(s) 20 is(are) reserved for pre-booked calls, the decision field 62 and the operation field 64 can be omitted.

The invention is not limited by the above embodiments but may be varied within the scope of the appended patent claims.

The invention claimed is:

1. A destination control system of an elevator system having an elevator group having plural elevators controlled thereby, comprising:

a destination call input device providing at least one destination call to the destination control system;

a destination control configured to allocate to at least one of the elevators of the elevator group to service a destination call, the destination control prioritizing elevators to calls, and establishing different elevator call priority for different elevators of said elevator group;

an identification reader, operatively connected to the destination control, and arranged in proximity to at least one elevator, to receive an identifier input providing an identity of an elevator user; and a memory for a travel history of individual users in the elevator system as identified by an identifier of each of the users;

the destination call input device further including an input for entering a "pre-booked" destination call including at least a predetermined operating time in the future for a use of an elevator, the input being provided by a pre-booking elevator user identified by the identifier input;

the destination control being configured to handle destination calls based on destination call data comprising a departure floor, a destination floor, a correlated operating time for the pre-booked destination call as well as a correlated identifier of the pre-booking user providing the pre-booked destination call;

the destination control allocating all pre-booked destination calls to the elevators of the elevator group with a higher elevator call priority than otherwise equivalent not pre-booked destination calls, the priority of the allocation of a pre-booked destination call of a user is dependent on a number of unused and/or confirmed used pre-booked destination calls issued by the user wherein the destination control system is configured to allow non-pre-booked calls made in an elevator lobby without providing an input used to book a pre-booked call;

a pre-booked destination call being confirmed as used by the destination control only after the destination control has checked within a certain time frame before predetermined operating time of the pre-booked call that the identifier of an elevator user obtained by the identification reader corresponds to the identifier of the pre-booking user correlated to the pre-booked destination call.

2. The destination control system according to claim 1, wherein each user is allocated an individual priority and that the destination call input device includes a display for indicating the allocated priority to the user.

3. The destination control system according to claim 1, wherein, for the allocation of the destination, the destination control calls a cost function having different parameters including passenger waiting time, passenger riding time, and energy consumption, which different parameters are weighted by weighting coefficients in the cost function, said destination control being configured to assign different weighting coefficients to different users.

4. The destination control system according claim 3, wherein, to increase the priority of a pre-booked destination call, the weighting coefficient of the passenger waiting time and/or riding time of a pre-booked destination call of a user is increased with respect to a corresponding weight coefficient of a non-pre-booked destination call.

5. The destination control system according to claim 1, wherein at least one particular elevator of the elevator group is reserved for pre-booked destination calls.

6. The destination control system according to claim 5, wherein an access control is arranged for a particular elevator which comprises an identification reader.

7. The destination control system according to claim 1, wherein the elevator has a capacity, a part of the capacity of the elevator is reserved for pre-booked destination calls.

8. The destination control system according to claim 1, wherein the destination call input device is a mobile device interface, terminal or a destination input panel and the destination control is connected by a wired and/or wireless input node for connection of the destination call input device.

9. The destination control system according to claim 1, wherein an access area to a particular reserved elevator is restricted and access to said area is only possible for users having an identifier correlated to a pre-booked destination call within a limited time frame.

10. The destination control system according to claim 1, wherein the destination control is implemented as an algorithm on a microprocessor system.

11. The destination control system according to claim 1, wherein the destination call input device allows the user to cancel a pre-booked destination call up to a preset time period before the operating time of the pre-booked destination call.

12. An elevator group control comprising a destination control system according to claim 1.

13. An elevator system having at least one elevator group comprising an elevator group control with a destination control system according to claim 1.

14. An elevator system according to claim 13, wherein the destination control system is a part of the elevator group control, arranged on a module thereof.

15. A method for allocating destination calls to elevators in an elevator system having an elevator group with several elevators comprising:

inputting a destination call via a destination call input device communicating with a destination control system, the destination call being allocated to at least one of the elevators of the elevator group, wherein said inputting includes entry of a desired time of a "pre-booked" destination call including at least a desired operating time in the future for a use of an elevator and the destination call is stored as data that includes a departure floor, a destination floor, as well as a correlated identifier of a user issuing the pre-booked destination call, allocating all pre-booked destination calls a higher priority to the elevators of the elevator group than otherwise equivalent non pre-booked destination calls, wherein each user of plural users is assigned an individual priority which is dependent on a number of confirmed used pre-booked destination calls, the method is configured to accept non-pre-booked calls made in an elevator lobby without providing an input used to book a pre-booked call; and calling the at least one allocated elevator of the elevator group at the desired operating time of a pre-booked destination call;

obtaining an identifier of an elevator user for the at least one allocated elevator of the elevator group;

wherein the inputting, for the pre-booked destination call, determines the identifier of the user having issued the pre-booked destination call and the identifier of the elevator user are the same to confirm correct use of the pre-booked destination call.

16. The method according to claim 15, wherein at least one particular elevator or at least a certain area in at least one elevator is reserved for pre-booked destination calls; said method further comprising enabling access to one of said at least one particular elevator or to the certain area only after retrieving a correct identifier for a pre-booked destination call to be served within a certain time frame.

17. The method according to claim 15, wherein the priority affects user-specific individual weighting coefficients of parameters of a cost function of an allocation algorithm.

18. The method according to claim 15, wherein upon registration of a pre-booked call given by an individual destination call input device, issuing a confirmation message by the destination control system to said individual destination call input device.

19. The method according to claim 15, wherein the destination control system issues, after having made the allocation for the pre-booked call, a message identifying an allocated elevator to an individual said destination call input device.

* * * * *